United States Patent [19]

Tanaka et al.

[11] 4,345,134

[45] Aug. 17, 1982

[54] HIGH FREQUENCY HEATING APPARATUS

[75] Inventors: Junzo Tanaka, Fujiidera; Masatomo Orita, Nara, both of Japan

[73] Assignee: Matsushita Electric Industrial Co., Ltd., Osaka, Japan

[21] Appl. No.: 154,418

[22] PCT Filed: Dec. 8, 1978

[86] PCT No.: PCT/JP78/00043

§ 371 Date: Sep. 11, 1979

§ 102(e) Date: Sep. 11, 1979

[87] PCT Pub. No.: WO79/00562

PCT Pub. Date: Aug. 23, 1979

[30] Foreign Application Priority Data

Jan. 30, 1978 [JP] Japan ..... 53/9732

[51] Int. Cl.[3] ..... H05B 6/68

[52] U.S. Cl. ..... 219/10.55 B

[58] Field of Search ..... 219/10.55 B, 10.55 R, 219/10.55 E

[56] References Cited

U.S. PATENT DOCUMENTS

| | | | |
|---|---|---|---|
| 3,320,396 | 5/1967 | Boehm | 219/10.55 B |
| 3,569,656 | 3/1971 | White et al. | 219/10.55 B |

FOREIGN PATENT DOCUMENTS

| | | | |
|---|---|---|---|
| 52-59341 | 5/1977 | Japan | 219/10.55 B |
| 52-65337 | 5/1977 | Japan | 219/10.55 B |
| 52-67846 | 6/1977 | Japan | 219/10.55 B |
| 53-15647 | 2/1978 | Japan | 219/10.55 B |
| 53-15648 | 2/1978 | Japan | 219/10.55 B |
| 53-20142 | 2/1978 | Japan | 219/10.55 B |
| 53-28551 | 3/1978 | Japan | 219/10.55 B |

*Primary Examiner*—B. A. Reynolds
*Assistant Examiner*—Philip H. Leung
*Attorney, Agent, or Firm*—Spencer & Kaye

[57] ABSTRACT

A composite heating apparatus provided with means for both high frequency dielectric heating and resistance heating. At the start of cooking, all the input power is supplied to the heater to accelerate the rise of the temperature in the heating chamber, and the power input to the heater is automatically controlled when the temperature in the heating chamber reaches a predetermined temperature to maintain the temperature in the heating chamber constant. At the same time, the high frequency generator is operated at comparatively low output. This makes possible the simultaneous cooking by dielectric and resistance heating even in areas not favored with a satisfactory power supply situation on the one hand and, on the other hand, is expected to contribute to energy saving in areas favored with a satisfactory power supply condition.

2 Claims, 4 Drawing Figures

HIGH FREQUENCY HEATING APPARATUS

TECHNICAL FIELD

This invention relates to a composite heating apparatus capable of providing dielectric heating with high frequency energy, and resistance heating for heating and cooking by increasing the ambient temperature in a single heating chamber to a high temperature.

BACKGROUND OF THE INVENTION

A conventional composite heating apparatus of this type is commercially produced in which the high frequency and resistance heating are operated separately, or the resistance heating is switched automatically to heating by high frequency energy. In either type, the cooking effect obtained by simultaneous dielectric heating in which the food is heated from within and resistance heating in which the food is heated from the outside cannot be expected. Even if there would be available a composite heating apparatus capable of dielectric heating and resistance heating simultaneously, simultaneous operation of a high frequency heating apparatus of the electric capacity of, say, 1.2 KW and a resistance heating apparatus of 1.2 KW would result in a current of about 24 A flowing in an ordinary home supplied with a source voltage of 100 V, thus posing the problem that such an apparatus cannot be used due to power consumption limitations in areas having unfavorable power supply situations. Such an apparatus requires a power supply and power equipment of a large capacity, and is difficult to commercialize. Further, the simultaneous operation of both large output heaters is not desirable from the viewpoint of cooking effects and energy saving.

SUMMARY OF THE INVENTION

Accordingly, this invention makes possible cooking by simultaneous heating together with use in an area having unfavorable power supply conditions by appropriately controlling the high frequency dielectric heating output and resistance heating according to the type of food. An embodiment of the present invention will be described below with reference to the attached drawings.

BEST MODE FOR CARRYING OUT THE INVENTION

Figure 1:
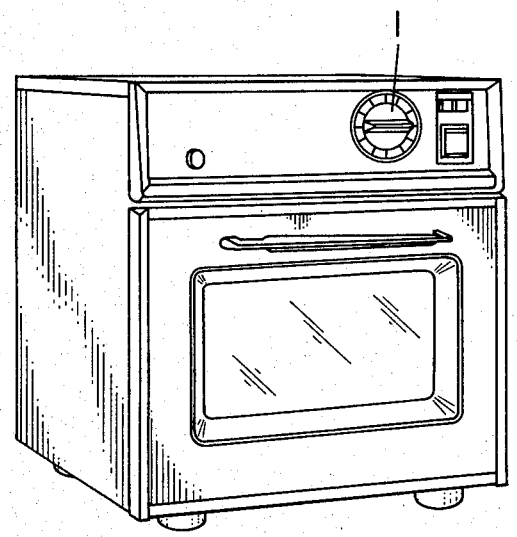
FIG. 1 is a general perspective view of a high frequency heating apparatus according to an embodiment of the present invention.
Figure 2:
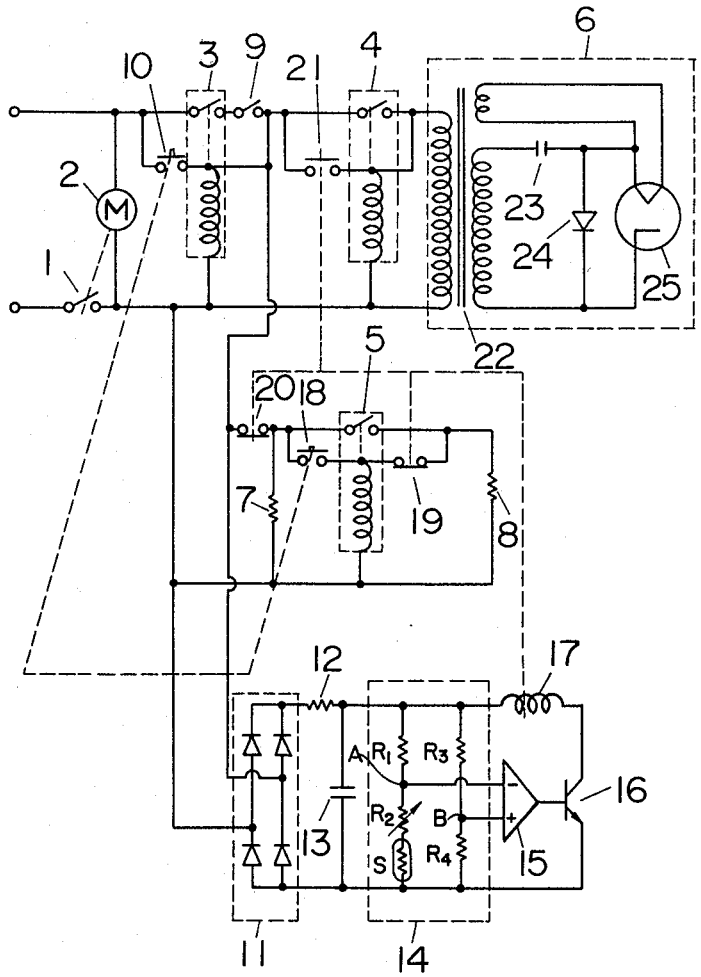
FIG. 2 is an electrical circuit diagram of the same apparatus.

In FIGS. 1 and 2, 1 shows a time switch operated by a timer motor 2. 3, 4 and 5 show power relays, in which 4 shows a power relay for actuating a high frequency generator 6, 5 a power relay for cutting off a heater 8 connected in parallel with a heater 7, thus switching the output of the heating apparatus from a strong to a weak state, and 3 a power relay for interrupting both circuits. In other words, upon depression of an operating switch

10 when a door switch 9 is closed, a coil of the power relay 3 is excited, thus turning on the power relay 3. Once power is supplied to the coil, a self-holding circuit is formed, so that power continues to be supplied even after the operating switch 10 is turned off. If the door switch 9 is turned off, however, the self-holding circuit is released, thus turning off the power relay 3. A self-holding circuit is formed in a similar fashion in the power relays 4 and 5 as in the power relay 3.

Next, an embodiment of the temperature control means in this apparatus will be explained. 11 shows a full-wave rectifier circuit. The rectified current flows to a bridge circuit 14 through a smoothing resistor 12 and a capacitor 13. 15 shows a comparator. As shown in the drawing, when the voltage at point A of the bridge circuit is reduced below the voltage at point B, a current flows in the transistor 16, thus exciting a coil 17 of the relay. In other words, power is supplied to the coil 17 when the relation $$\frac{S + R_2}{S + R_1 + R_2} < \frac{R_4}{R_3 + R_4}$$

is established among the resistors $R_1$, $R_2$, $R_3$, $R_4$ and a thermistor S. Thus, when the thermistor S in the heating chamber (not shown) is at a normal temperatures, its resistance is high and therefore the potential at point A is higher than that at point B, thus preventing the transistor 16 from being conductive. When the temperature in the heating chamber is increased and the resistance value of the thermistor S is reduced, however, the potential at point B exceeds that at point A, so that the transistor 16 is turned on thus supplying power to the coil 17 of the relay. The numerals 19, 20 and 21 show contacts of the relay coil 17, and the contacts 19 and 20 are normally closed and the contact 21 normally open. Also, $R_2$ is a variable resistor for temperature adjustment.

The above-mentioned configuration will be explained in the sequence of operation. When the operating switch 10 is operated, an operating switch 18 of the power relay 5 interlocked therewith is also operated. The power relays 3 and 5 are actuated and power is supplied to the heaters 7 and 8, thus rapidly increasing the temperature in the heating chamber. When the temperature in the heating chamber reaches a predetermined level and this is detected by the thermistor S, the relay coil 17 is supplied with power. As a result, the normally closed contacts 19 and 20 are opened, the power supply to the heaters 7 and 8 is interrupted and resistance heating is stopped. At the same time, the normally open contact 21 is closed, and the power relay 4 is turned on, so that the high frequency generator circuit 6 is supplied with power, thus effecting high frequency heating. An object to be cooked placed within the heating chamber is heated by the high temperature within the heating chamber and the high frequency at the same time. When the temperature within the heating chamber decreases by interruption of the power supply to the heater circuit, the temperature of the thermistor S decreases and the potential at point A of the bridge circuit 14 exceeds that at point B, so that the transistor 16 is turned off, thus cutting off power supply to the relay coil 17. At this time, even if the contact 19 is switched from open to closed, the power relay 5 is not actuated, and even if the contact 21 is switched from closed to open, the power relay 4 continues to be conductive. Further, the contact 20 is switched from open to on and the heater 7 is supplied with power, thus increasing the temperature in the heating chamber. When the temperature in the heating chamber reaches a predetermined level, the above-mentioned cycle is repeated. Thus, once the predetermined temperature is reached, thereafter, only the heater 7 is turned on and off to keep the temperature in the heating chamber constant and high frequency heating is continuously effected.

Explanation will be made of the high frequency generator 6. 22 shows a high voltage transformer, the secondary side of which is connected with a half-wave voltage-doubler rectifier circuit including a capacitor 23 and a diode 24 in series. A magnetron 25 is connected in parallel with the diode 24.

Figure 3:
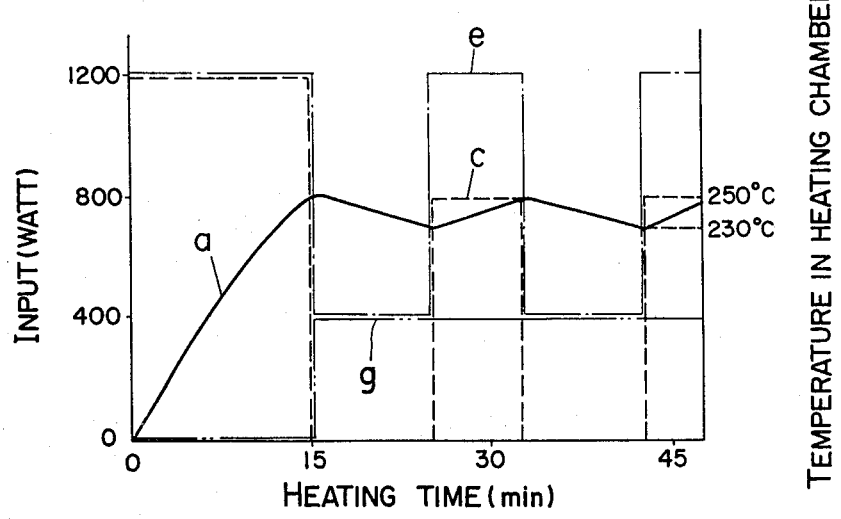
FIG. 3 is a diagram showing the relations among the input, heating time and temperature in the chamber in the same apparatus.
Figure 4:
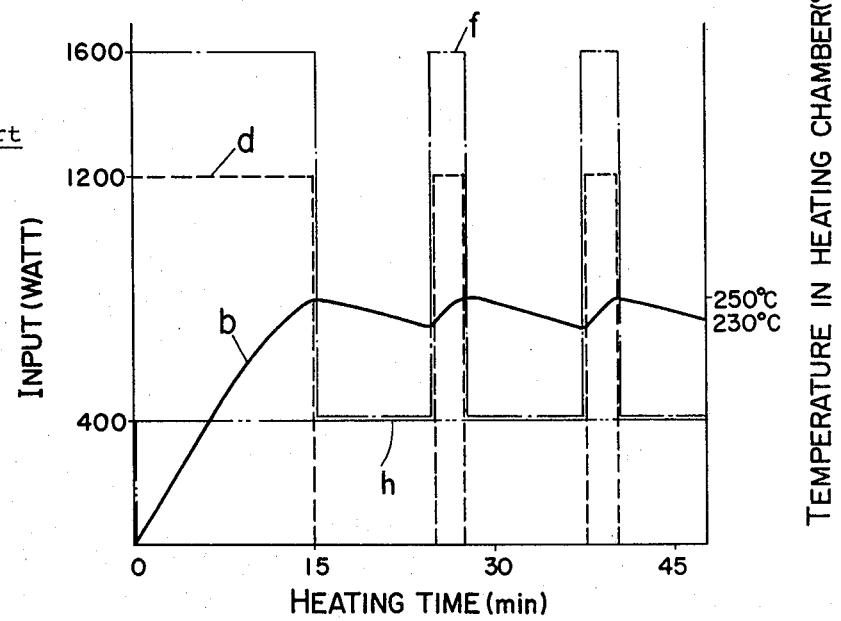
FIG. 4 Prior Art
FIG. 4 is a diagram showing a relationship obtained with prior art apparatus corresponding to FIG. 3.

With respect to the input power distribution for high frequency dielectric heating and resistance heating, a comparision will be made between the high frequency heating apparatus having a heater according to the present invention and a conventional type of heating apparatus which effects simultaneous heating from the beginning of the heating cycle, as shown in FIGS. 3 and 4.

In FIGS. 3 and 4, the solid lines show the temperature in the heating chamber, the dashed lines c and d the input power to the resistance heaters, and e the single dot-dash lines f the total input power to the high frequency heating apparatus and the double dot-dash lines g and h the input power to the high frequency generator.

Comparison of temperatures in the heating chamber in FIGS. 3 and 4 show that until the lapse of 15 minutes after heating begins, both the curves a and b rise in the same manner, and that at 250° C. where the resistance heaters are turned off, the curves a and b decrease to 230° C. After resistance heater 7 is turned on at 230° C., it takes considerable time before 250° C. is reached in the present invention since the total amount of resistance heating is low as shown in FIG. 3, while the rise time is short in the prior art shown in FIG. 4. In the prior art, however, the dielectric heating and resistance heating are conducted simultaneously from the beginning, with the result that the total power input is large leading to difficulties in areas not favored with good power supply conditions.

According to the present invention, in contrast, the whole heating apparatus may be considered as a high frequency heating apparatus with a heater of 1.2 KW total power input which operates in such a manner that, as shown in FIG. 3, all the power of 1.2 KW is supplied initially to the heaters 7 and 8, and after the temperature in the heating chamber reaches a predetermined level, 800 watts is supplied to the heater 7 and 400 watts to the high frequency heating generator 6. As a result, the temperature within the heating chamber is kept constant by the 800 watts input to heater 7, which is switched on when the temperature decreases to 230° C. and off when the temperature increases to 250° C., and by the simultaneous heating 400 watts of input power is supplied to heater 8 only during the initial 15 minute warm up period when the input power to generator 6 is zero, heater 8 being deenergized thereafter. This shortens the cooking time on the one hand and, on the other hand, is expected to produce an effect substantially equal to the case in which simultaneous heating is conducted from the beginning.

A cooking menu requiring simultaneous heating includes roast chicken, roast beef, etc. most of which are required to be heated for a long time at a low output. They cannot be cooked satisfactorily, being overheated with a high frequency output as high as 600 W. A good cooking result is obtained with a low output of from 150 W to 200 W.

In the foregoing embodiments, a power relay is used for facilitating the understanding. The same effect will be achieved by applications using an electronic circuit such as a microcomputer without using the power relay. Also, instead of the thermistor used as a temperature detecting element, other type of temperature detecting element may be used with equal effect.

INDUSTRIAL APPLICABILITY

As explained above, according to the present invention, the high frequency heating apparatus is operated after the temperature in the heating chamber reaches a predetermined level. For example, such food items as meat or hamburg steak containing oily juice are subjected to high frequency heating only after their surfaces are hardened by heat. This prevents the nutritious and delicious oily juice from oozing out. If the high frequency heating is preceded by resistance heating or simultaneous heating is conducted from the beginning, the inside of the food is heated before the surface thereof is hardened, with the result that oily juice therein oozes out, thus leading to the loss of both nutrition and taste.

Further, the dielectric and resistance heating are capable of being conducted at the same time with the limited capacity of the power supply, the scope of the cooking menu can be enlarged, and a satisfactory cooking result can be achieved.

Therefore, the apparatus is available for use even in areas not favored by a satisfactory power supply situation on the one hand, while the apparatus is expected to contribute to energy saving in the areas favored by a satisfactory power supply condition on the other hand.

We claim:

1. In a high frequency heating apparatus including a heating chamber, a high frequency generator for radiating high frequency energy into said heating chamber, resistance heating means having low and high heating levels, and temperature detecting means for detecting the temperature within said heating chamber, the combination including means for initially energizing said resistance heating means at said high heating level, said high frequency generator being deenergized;

means for energizing said high frequency generator and deenergizing said resistance heating means when said temperature detecting means senses that the temperature within said heating chamber has reached a first predetermined temperature, said high frequency generator being thereafter continuously energized; and means for switching said resistance heating means to said low heating level when said temperature detecting means senses that the temperature within said heating chamber has decreased to a second predetermined temperature below said first predetermined temperature, said resistance heating means being thereafter intermittently energized at said low heating level when said temperature detecting means senses that the temperature within said heating chamber has decreased to said second predetermined temperature, the temperature within said heating chamber being thereby increased gradually to said first temperature and maintained between said first and second predetermined temperatures, the total input power to said high frequency generator and said resistance heating means being maintained within the electrical power capacity of said high frequency heating apparatus.

2. A high frequency heating apparatus according to claim 1, wherein said resistance heater means comprises first and second parallel-connected resistance heaters, and means for disconnecting one of said resistance heaters for switching the output of said resistance heater means from said high heating level to said low heating level.

* * * * *